US005903109A

United States Patent [19]

Van Gennip et al.

[11] Patent Number: 5,903,109

[45] Date of Patent: May 11, 1999

[54] ELECTRODELESS LOW-PRESSURE DISCHARGE LAMP WITH SPECIFIC ELECTRICAL CONDUCTOR CLAMPING MEANS

[75] Inventors: Nicasius G.T. Van Gennip; Petrus J.M. Fransen, both of Eindhoven, Netherlands; Winand H.A.M. Friederichs, Bath, N.Y.; Petrus H. Antonis, Eindhoven, Netherlands

[73] Assignee: U.S. Philips Corporation, New York, N.Y.

[21] Appl. No.: 08/843,976

[22] Filed: Apr. 18, 1997

[30] Foreign Application Priority Data

Apr. 19, 1996 [EP] European Pat. Off. ..... 96201059

[51] Int. Cl.[6] ..... H01J 1/50

[52] U.S. Cl. ..... 315/248; 315/241 R; 313/318.01

[58] Field of Search ..... 362/318.01; 315/248, 315/241 R; 313/483, 484, 318.01

[56] References Cited

U.S. PATENT DOCUMENTS 5,130,912 7/1992 Friederichs et al. ..... 362/263

5,291,091 3/1994 Eggink et al. ..... 313/161

5,563,474 10/1996 Wessels et al. ..... 315/248

5,804,911 9/1998 Van Gennip et al. ..... 313/318.01

*Primary Examiner*—Sandra O'Shea

*Assistant Examiner*—Matthew J. Gerike

*Attorney, Agent, or Firm*—F. Brice Faller

[57] ABSTRACT

An electrodeless low-pressure discharge lamp according to the invention has a lamp vessel (1) which is closed in a gastight manner, which contains an ionizable filling, and which has a cavity (10). In the cavity (10) an elongate coil (2) is positioned with a primary and a secondary winding (21, 22, respectively) of an electrical conductor (20) around a coil former (3) which has a tip (30) which points into the cavity (10). The electrical conductor (20) from which the secondary winding (22) is formed extends from a first end (22*a*) of the secondary winding (22) facing the tip (30) into a recess (32) of the tip (30) of the coil former (3) and is clamped therein. The first end (22*a*) of the secondary winding (22) can be easily fastened in this manner.

5 Claims, 3 Drawing Sheets

Figure 1:
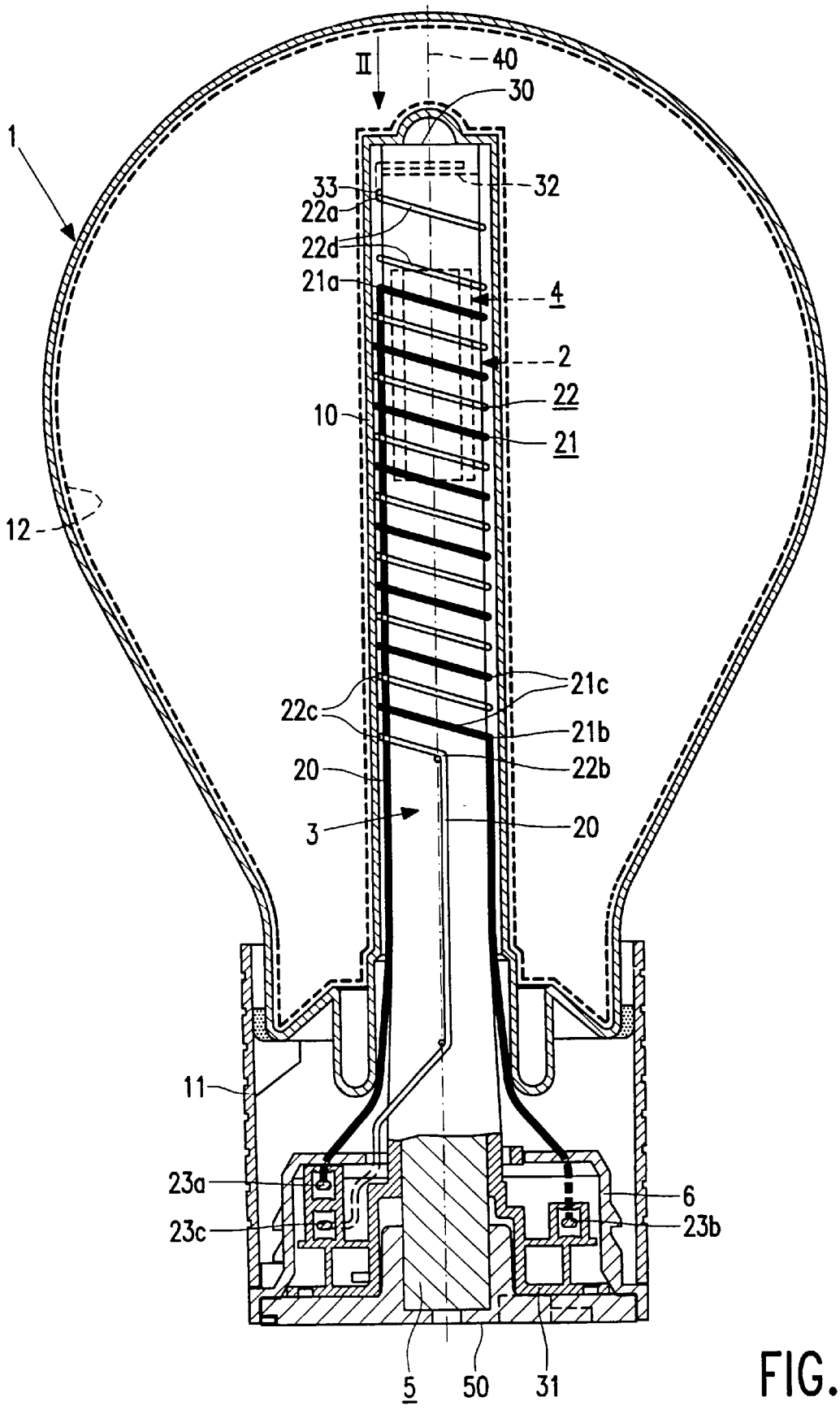

ELECTRODELESS LOW-PRESSURE DISCHARGE LAMP WITH SPECIFIC ELECTRICAL CONDUCTOR CLAMPING MEANS

The invention relates to an electrodeless low-pressure discharge lamp comprising a lamp vessel which is closed in a gastight manner, which contains an ionixable filling, and which has a cavity in which an elongate coil with a primary and a secondary winding of an electrical conductor is arranged around a coil former with a tip which points into the cavity, which windings each have a first end which faces towards the tip of the coil former and each have a second, opposed end, the first end of the secondary winding being a free end and the second end thereof being electrically connected to the first end of the primary winding.

Such an electrodeless low-pressure discharge lamp is known from EP-A-162504. The primary winding is connected with its ends to a high-frequency supply which is accommodated in a housing fastened to the lamp vessel and also supporting a lamp cap. A high-frequency magnetic field is generated by means of the primary winding of the coil during operation so as to maintain an electric discharge in the lamp vessel. The secondary winding, in which a potential gradient is generated which is opposed to that in the primary winding, serves to limit electromagnetic interference.

It is an object of the invention to provide a lamp of the kind described in the opening paragraph which is of a simple construction which renders possible a simple fastening of the free end of the secondary winding.

According to the invention, this object is achieved in that the electrical conductor from which the secondary winding is formed extends from the first end of the secondary winding to inside a recess of the tip of the coil former and is clamped therein. The conductor can be readily fastened in this construction in that it is introduced into said recess. A separate component for holding the electrical conductor at the first end of the secondary winding is not necessary. Preferably, the electrical conductor is not given an end until after it has been introduced into the recess. The electrical conductor is easy to handle during its application in that case because it can be held by the portion which will become unnecessary afterwards. The electrical conductor may be introduced into the recess, for example, through pulling at the unnecessary portion which is subsequently cut off.

It is favorable for reasons of safety when the electrical conductor ends inside the recess, so that it cannot be touched even if the lamp vessel is removed.

An attractive embodiment of the electrodeless low-pressure discharge lamp according to the invention is characterized in that the electrical conductor ends in a widened zone of the recess. After the electrical conductor has been introduced into the recess, an end can nevertheless be easily formed thereto in that it is cut off in the widened zone of the recess. It is favorable for this when a cutting member is used which is pressed into the widened zone in a direction transverse to the tip.

A favorable embodiment of the electrodeless low-pressure discharge lamp according to the invention is characterized in that the primary and the secondary winding are together formed from an uninterrupted electrical conductor, of which electrical conductor a portion extends from the first end of the primary winding between the primary and the secondary winding via an electrical contact to the second end of the secondary winding. A separate electrical contact for connecting the second end of the secondary winding is redundant. This embodiment therefore has the advantage that two electrical contacts can suffice and that the electrical conductor need be fastened to an electrical contact only twice during the manufacture of the coil. Clamping electrical contacts are favorable for fast mounting. Preferably they are provided with knife edges for promoting the electrical contact to the conductor or for piercing an insulating sheath of an electrical conductor. An insulating sheath may be absent, provided the coil former has a comb which keeps mutually crossing portions of the electrical conductor spaced apart from one another. To render the coil safe to touch, however, the electrical conductor preferably has an electrically insulating sheath.

A favorable embodiment of the electrodeless low-pressure discharge lamp according to the invention is characterized in that the coil former surrounds a core of soft magnetic material, in that the primary and the secondary winding have turns which extend in an axial direction from the tip to beyond the core of soft magnetic material, and in that the secondary winding has additional turns between the first end of the primary winding and the tip of the coil former which extend in axial direction to beyond the core of soft magnetic material. When lamp parameters are changed, for example the nature of the filling, the self-inductance of the coil can be adapted through the choice of the turns around the core. The ignition voltage of the lamp may subsequently be influenced, if so desired, through the choice of the number and locations of the turns of the primary and secondary windings which extend towards the base beyond the core. After that, electromagnetic interference caused by the lamp may be reduced by means of the additional turns of the secondary winding without the self-inductance of the coil or the ignition behavior of the lamp being substantially changed thereby.

The electrodeless low-pressure discharge lamp may form part of a lighting unit which in addition comprises a supply unit. The supply unit may be, for example, integral with the electrodeless low-pressure discharge lamp, for example may be accommodated in a housing fastened to the lamp vessel, or alternatively may be separate from the lamp, for example connected to the lamp via a cable.

Figure 2:
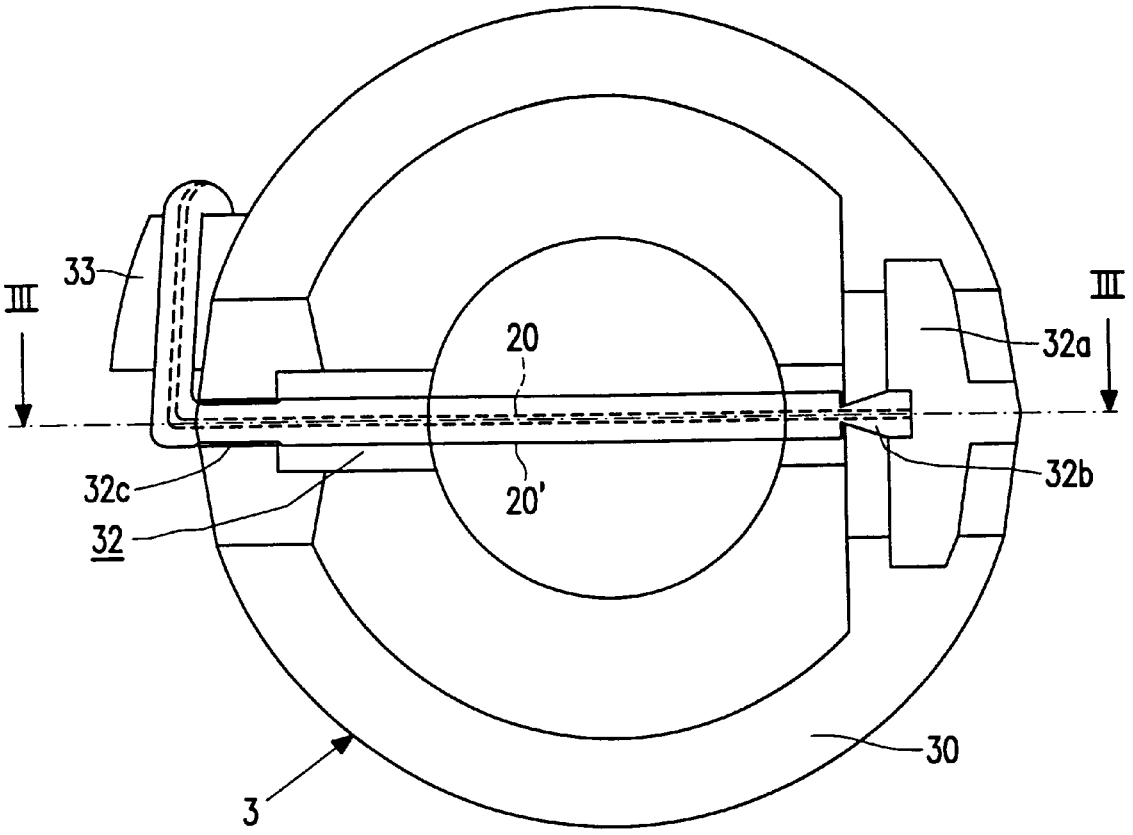
Figure 3:
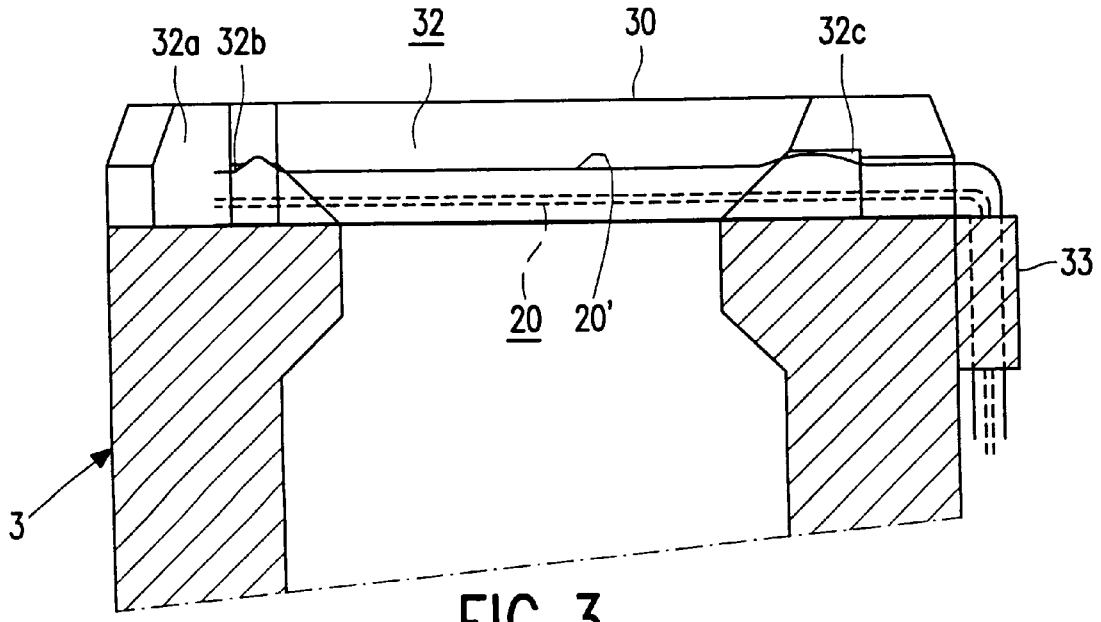
Figure 4:
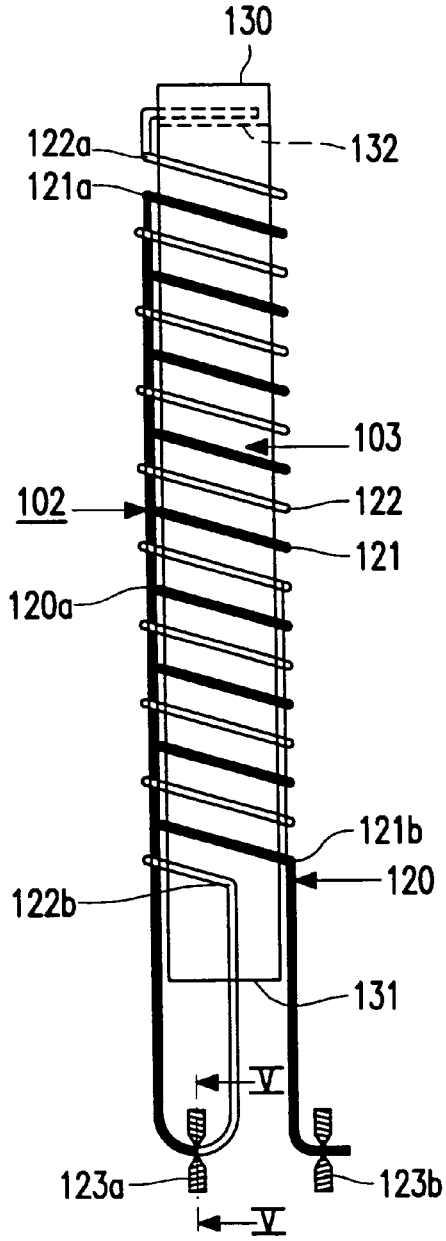
Figure 5:
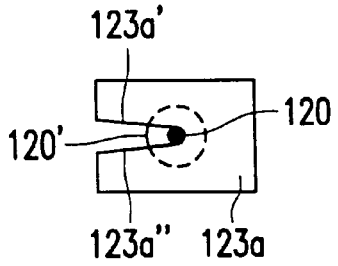

These and other aspects of the invention will be explained in more detail below with reference to the drawing in which:

FIG. 1 is a longitudinal sectional view of a first embodiment of the lamp according to the invention, with the coil shown in elevation, FIG. 2 shows a detail taken on the view II of the coil former of the lamp of FIG. 1, FIG. 3 is a longitudinal sectional view taken on the line III—III of the coil former of the lamp of FIG. 1, FIG. 4 shows the coil of a second embodiment of a lamp according to the invention, and FIG. 5 is a cross-section taken on the line V—V in FIG. 4.

The electrodeless low-pressure discharge lamp shown in FIG. 1 comprises a lamp vessel 1 which is closed in a gastight manner and which is fastened to a collar 11.

The lamp vessel 1 contains an ionizable filling, here a filling of mercury and a rare gas. The lamp vessel 1 is provided with a luminescent layer 12 at an inner surface. In an alternative embodiment, the filling of the lamp vessel comprises sodium and a luminescent layer is absent. The lamp vessel has a cavity 10 in which a coil 2 is positioned, provided with a primary and a secondary winding 21, 22 of an electrical conductor 20 around a coil former 3. The electrical conductor 20, of 0.15 mm diameter and shown in broken lines in FIG. 2 has an insulating sheath 20' with a diameter of 0.85 mm in this case. The coil former 3 has a tip 30 which points into the cavity 10, and a base 31 opposite thereto. A hollow cylindrical core 4 of soft magnetic material (shown in broken lines) is accommodated in the coil former 3 and has an axis 40. The core 4 of soft magnetic material is arranged around a metal heat conductor 5 which has a flanged end portion 50 facing away from the tip 30 of the coil former 3. The heat conductor 5 is shown in the portion of FIG. 1 depicted in longitudinal section only for reasons of clarity. The windings 21, 22 each have a first end 21*a*, 22*a* which is directed to the tip 30 of the coil former, and each have a second, opposed end 21*b*, 22*b*. The first end 22*a* of the secondary winding is a free end, and the second end 22*b* is electrically connected to the first end 21*a* of the primary winding 21. The electrical conductor 20 from which the primary winding 21 is coiled extends from the first and second ends 21*a*, 21*b* of the primary winding to a first and a second electrical contact 23*a*, 23*b*, respectively, at the base 31 of the coil former 3. The electrical conductor 20 which forms the secondary winding 22 of the coil 2 extends from the second end 22*b* of the secondary winding to a third electric contact 23*c* which is electrically connected to the first electric contact 23*a*. Said electrical conductor 20 extends from the first end 22*a* of the secondary winding 22 into a recess 32, to a depth of 4 mm, of the tip 30 of the coil former 3 and is clamped therein (see also FIGS. 2 and 3). The electrical conductor 20 is here guided along a projection 33 of the coil former 3. Alternatively, such a projection may be absent, for example if the first end of the secondary winding coincides with the recess in the tip of the coil former. The electrical contacts 23*a–c* are surrounded by a cap 6 of insulating material which at the same time keeps the flanged end portion 50 of the heat conductor 5, the coil former 3, and the collar 11 fastened to one another.

In the embodiment shown, the electrical conductor 20 ends inside the recess 32. The electrical conductor 20 here ends in a widened zone 32*a*, having a width of 5 mm, of the recess 32. The electrical conductor 20 was cut off by a cutter which was pressed into the widened zone 32*a* of the recess 32 in a direction transverse to the tip 30. The electrical conductor 20 is held clamped-in in a first, comparatively strongly narrowed portion 32*b* adjacent the widened zone 32*a*, and in a second, comparatively weakly narrowed portion 32*c* close to where the electrical conductor 20 enters the recess 32 from the secondary winding 22. The electrical conductor 20 was pressed home by means of a pressure member in a location opposite the widened zone 32*a* relative to the comparatively strongly narrowed portion 32*b* during cutting-off. The comparatively strongly narrowed portion 32*b* has a width gradient from 0.8 mm to 0.25 mm in a direction away from the widened zone 32*a*. The comparatively weakly narrowed portion 32*c* has a constant width of 0.7 mm.

The primary and secondary windings 21, 22 have turns 21*c*, 22*c* which extend in an axial direction away from the tip 30 to beyond the core 4 of soft magnetic material. The secondary winding 22 also has additional turns 22*d* which extend in axial direction to beyond the core 4 of soft magnetic material between the first end 21*a* of the primary winding 21 and the tip 30 of the coil former 3.

The coil 102 of a second embodiment of the lamp according to the invention is shown in FIG. 4. Components therein corresponding to those from the preceding Figures have reference numerals which are 100 higher. In the coil 102 shown in FIG. 4, the primary and secondary windings 121, 122 are jointly formed from an uninterrupted electrical conductor 120. A portion 120*a* of the electrical conductor 120 extends from the first end 121*a* of the primary winding 121 between the primary and secondary windings 121, 122 via an electric contact 123*a* to the second end 122*b* of the secondary winding 122. The electric contact 123*a* shown in more detail in FIG. 5 has knife edges 123*a*', 123*a*" which have cut through the insulating sheath 120' of the electrical conductor 120 and which keep the electrical conductor clamped in.

We claim:

1. An electrodeless low-pressure discharge lamp comprising a lamp vessel (1) which is closed in a gastight manner, which contains an ionizable filling, and which has a cavity (10) in which an elongate coil (2) with a primary (21) and a secondary winding (22) of an electrical conductor (20) is arranged around a coil former (3) with a tip (30) which points into the cavity (10), which windings (21, 22) each have a first end (21*a*, 22*a*) which faces towards the tip (30) of the coil former (3) and each have a second, opposed end (21*b*, 22*b*), the first end (22*a*) of the secondary winding (22) being a free end and the second end (22*b*) thereof being electrically connected to the first end (21*a*) of the primary winding (21), characterized in that the electrical conductor (20) from which the secondary winding (22) is formed extends from the first end (22*a*) of the secondary winding to inside a recess (32) of the tip (30) of the coil former (3), and is clamped therein.

2. An electrodeless low-pressure discharge lamp as claimed in claim 1, characterized in that the electrical conductor (20) ends inside the recess (32).

3. An electrodeless low-pressure discharge lamp as claimed in claim 2, characterized in that the electrical conductor (20) ends in a widened zone (32*a*) of the recess (32).

4. An electrodeless low-pressure discharge lamp as claimed in claim 1, characterized in that the primary (121) and the secondary winding (122) are together formed from an uninterrupted electrical conductor (120), of which electrical conductor a portion (120*a*) extends from the first end (121*a*) of the primary winding between the primary and the secondary winding via an electrical contact (123*a*) to the second end (122*b*) of the secondary winding.

5. An electrodeless low-pressure discharge lamp as claimed in claim 1, characterized in that the coil former (3) surrounds a core (4) of soft magnetic material, in that the primary (21) and the secondary winding (22) have turns (21*c*, 22*c*, respectively) which extend in an axial direction from the tip (30) to beyond the core (4) of soft magnetic material, and in that the secondary winding (22) has additional turns (22*d*) between the first end (21*a*) of the primary winding (21) and the tip (30) of the coil former which extend in axial direction to beyond the core of soft magnetic material.

* * * * *